US006722402B2

(12) United States Patent
Ambs et al.

(10) Patent No.: US 6,722,402 B2
(45) Date of Patent: Apr. 20, 2004

(54) APPARATUS FOR UNLOADING BAGS CONTAINING BULK PARTICULATE MATERIALS

(75) Inventors: Richard W. Ambs, Williamsport, PA (US); Anthony Boroch, Montoursville, PA (US)

(73) Assignee: The Young Industries, Inc., Muncy, PA (US)

( * ) Notice: Subject to any disclaimer, the term of this patent is extended or adjusted under 35 U.S.C. 154(b) by 0 days.

(21) Appl. No.: 10/211,335

(22) Filed: Aug. 5, 2002

(65) Prior Publication Data

US 2004/0020557 A1 Feb. 5, 2004

(51) Int. Cl.[7] ..... B65B 31/00

(52) U.S. Cl. ..... 141/114; 141/286; 141/364; 141/375; 222/181.2

(58) Field of Search ..... 141/114, 364, 141/375, 383, 385, 286; 222/180, 187.1, 181.2

(56) References Cited

U.S. PATENT DOCUMENTS 4,396,045 A * 8/1983 Cain ..... 141/286
4,872,493 A * 10/1989 Everman ..... 141/59
2001/0027822 A1 * 10/2001 Bertolo ..... 141/66

* cited by examiner

*Primary Examiner*—J. Casimer Jacyna
(74) *Attorney, Agent, or Firm*—Stevens, Davis, Miller & Mosher, LLP

(57) ABSTRACT

An apparatus for unloading a bag containing a bulk particulate material, having a discharge spout, generally consisting of a support structure, means for mounting such bag on the support structure, a hopper mounted on the support structure, a first member mounted on the support structure, having an opening through which the spout of a bag may be extended when the bag is mounted on the support structure, a second member mounted on support structure having an opening communicating with an inlet of the hopper, about which a portion of such spout extending through the opening of the first member may be fitted, and fluid actuated devices mounted on the support structure for displacing the first and second members relation to each other when the discharge spout of the bag is extended through the opening in such first member and fitted about such second member to cause a portion of spout to be interposed between such first and second members in clamped relation.

17 Claims, 2 Drawing Sheets

APPARATUS FOR UNLOADING BAGS CONTAINING BULK PARTICULATE MATERIALS

This invention relates to an apparatus for unloading bags containing bulk particulate materials and more particularly to such an apparatus having improved means for detachably securing the discharge spouts of such bags to a hopper of such apparatus, permitting the free flow of material from such bags into such hopper.

BACKGROUND OF THE INVENTION

In several industries utilizing bulk particulate materials such as powders, granules, pellets and the like, such materials often are loaded in large bags for storage, transportation and other purposes. Typically, such bags include a main body portion in which the material is loaded, a set of straps on the upper end thereof from which the bag may be suspended, an inlet in the upper end thereof through which material may be loaded into the main body portion when the bag is suspended by its straps, and an elongated spout at the lower end thereof through which material may be discharged into a vessel, a material transport line, a processing apparatus or another form of receptacle.

In a typical use of such a container, the bag may be suspended from its straps on a support frame, the spout may be closed by a rope or other means and folded against the main body portion thereof, material may be fed into the inlet and then the inlet is closed. The bag containing the material thus loaded may then be transported to a storage area, usually by a forklift truck and placed on a pallet. When it is desired to transfer the material to another receptacle such as a vessel, transport the material to another location through the use of a conveying line or perhaps feed all or a portion of the material into a processing apparatus, the bag is transported to an unloading site and maneuvered into a suspended position with the spout thereof aligned above a hopper, the spout is unfolded and placed into the hopper and the closure device is removed to allow the material to gravity flow through the spout and the hopper into the selected receptacle.

In such an operation, it has been found that regardless of the care taken to position and maintain the discharge spout in the receiving hopper, a certain amount of spillage occurs resulting in a loss of material, and dust often escapes into the ambient atmosphere creating an environmental hazard. Accordingly, it is the principal object of the present invention to provide an unloading apparatus for such containers, and particularly an assembly for connecting the spouts of such bags to the hopper of such an apparatus, in which spillage of material being unloaded and the creation of dust is prevented.

SUMMARY OF THE INVENTION

The present invention provides an apparatus for unloading a bag of the type described, capable of preventing the spillage of material and the creation of dust during the unloading thereof, which generally consists of a support means, means for mounting the bag on such a support means, a hopper mounted on the support means, a first member having an opening through which the spout of the bag may be inserted when the bag is mounted on the support means, a second member having an opening communicating with an inlet of the hopper, about which a portion of the spout extending through the opening of the first member may be fitted, and means mounted on the support means for displacing the first and second members together when the spout is inserted through the opening of the first member and fitted about the second member to cause a portion of the spout to be interposed between such members in clamped relation.

DETAILED DESCRIPTION OF AN EMBODIMENT OF THE INVENTION

Figure 1:
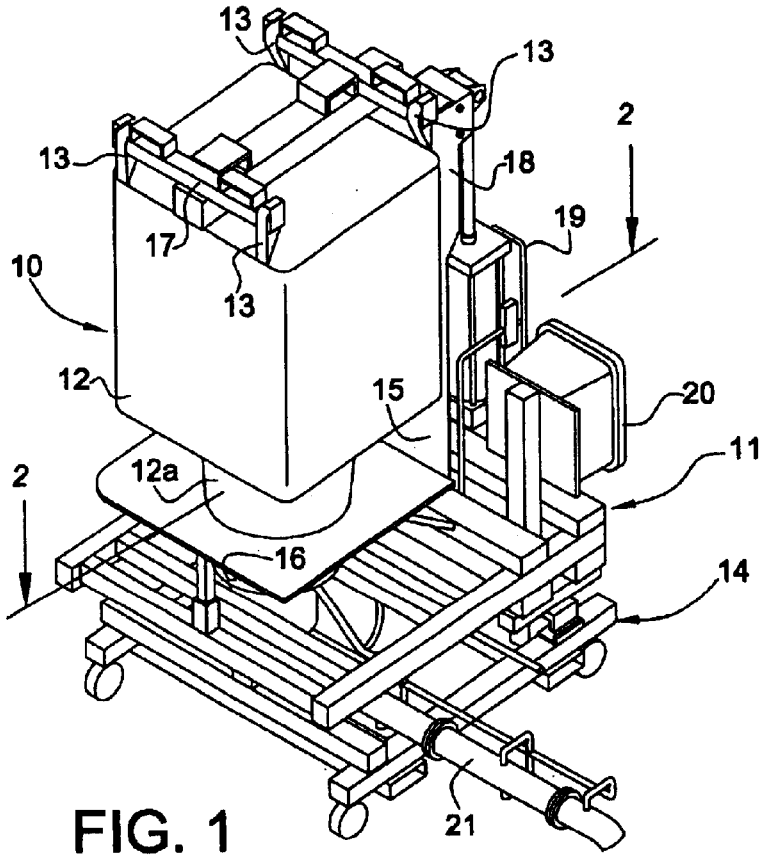
FIG. 1 is a perspective view of an apparatus for unloading a bag containing a bulk particulate material, embodying the present invention.

Referring to FIG. 1 of the drawings, there is illustrated a bag 10 adapted to hold a bulk particulate material, and an apparatus 11 for unloading such bag, embodying the present invention. The bag consists of a main body portion 12 formed of a sturdy, canvas-like material, provided with a set of straps 13 formed on the upper end of the main body portion for suspending the bag, an inlet at the upper end thereof through which material may be loaded into the main body portion thereof when the bag is suspended from its straps and a discharge spout 12*a* provided on the lower end of the main body portion.

Unloading apparatus 11 consists of a support frame 14 including a mast 15, a hopper 16 through which the material from a bag is discharged and a carrier member 17 removably mountable on the mast of the support frame and from which the bag is suspended with the spout thereof vertically aligned with the hopper of the apparatus. Carrier member 17 is removably mounted on a slide member 18 provided on the upper end of the mast and displaceable vertically relative thereto by means of a fluid actuated cylinder assembly 19 having the cylinder portion thereof rigidly mounted on the support frame and the rod portion thereof operatively connected to the slide member 18. A control unit 20 also is mounted on the support frame for operating the cylinder assembly and other mechanisms provided on the support frame. The hopper includes an upwardly opening inlet and a downwardly opening outlet communicating with the inlet of a pneumatic conveying line 21. Although the apparatus illustrated in FIG. 1 shows the hopper thereof communicating with a pneumatic conveying line, it will be appreciated that the outlet of the hopper thereof may communicate with any other form of receptacle such as a vessel, a processing apparatus or another form of transport line. The unloading apparatus may be stationary or mobile. In the mobile configuration, it may be mounted on a set of wheels as shown for relocating the apparatus or may be provided with a set of slots for receiving the blades of a forklift truck which may be used to relocate the apparatus.

Figure 2:
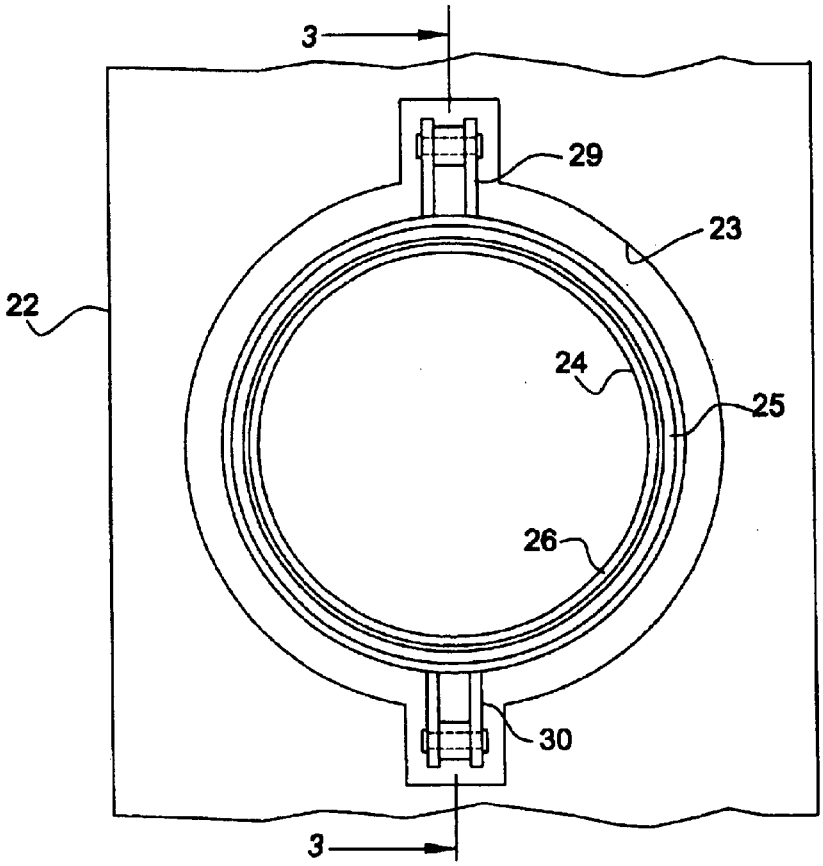
FIG. 2 is an enlarged cross-sectional view taken along line 2—2 in FIG. 1, having portions thereof broken away.

As best shown in FIGS. 1 and 2, a support pan 22 is provided above the hopper. The pan is substantially horizontally disposed, supported on the support frame and includes a circular opening 23 which is disposed substantially coaxially with inlet opening 24 of the hopper. The purpose of pan 22 is to support the weight of the bag of bulk material if the bag is lowered too far.

Figure 3:
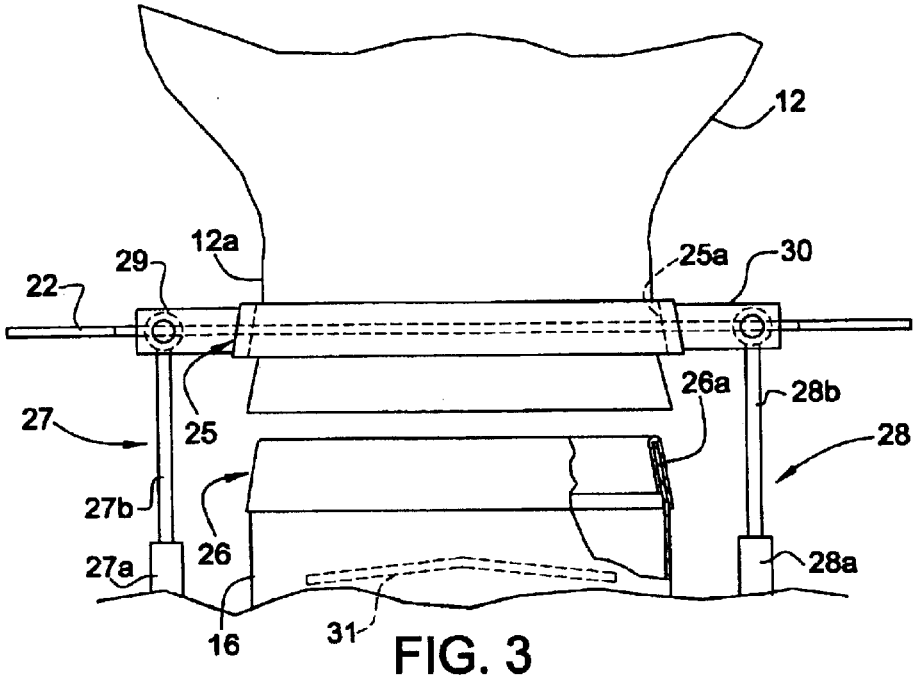
FIG. 3 is a cross sectional view taken along line 3—3 in FIG. 2, illustrating the discharge spout of a bag being unloaded and certain components of an assembly for connecting and securing such spout to the hopper of the apparatus, in a first relationship.
Figure 4:
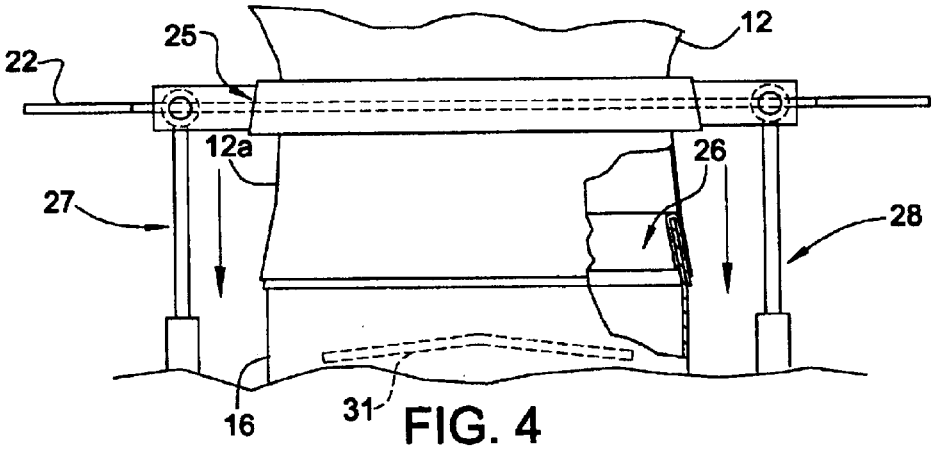
FIG. 4 is a view similar to the view shown in FIG. 3, illustrating such spout and components in a sequential relationship.
Figure 5:
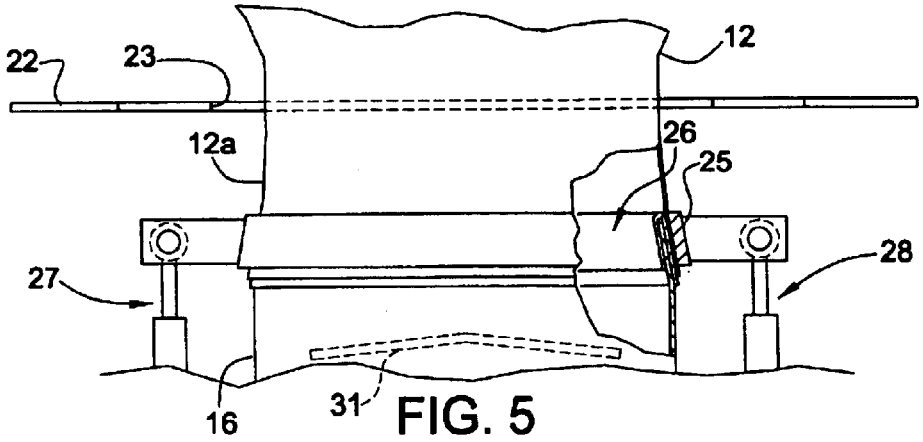
FIG. 5 is a view similar to the view shown in FIG. 4, illustrating such spout and components in a still further sequential relationship.

FIGS. 3 through 5 illustrate an assembly of components for connecting and securing the spout of a bag 12 mounted on apparatus 11 as shown in FIG. 1, extending through opening 23 of the support pan, to hopper 16. Such assembly includes an upper, annular member 25, a lower annular member 26 and a pair of air actuated cylinder assemblies 27 and 28. Lower annular member 26 is rigidly mounted on the upper end of hopper 16 and is formed with a frusto-conically configured outer wall surface 26*a*. Upper annular member 25 is axially aligned with lower annular member 26, provided with an inner, frusto-conically configured wall surface 25*a* having an angle relative to the axis thereof substantially similar to the angle of wall surface 26*a*, and further provided with sets 29 and 30 of radially projecting brackets. Cylinder assembly 27 includes a cylinder portion 27*a* rigidly mounted at a lower end thereof on the support frame, and an extendable rod portion 27*b* connected at an upper end thereof to bracket set 29. Similarly, cylinder assembly 28 includes a cylinder portion 28*a* rigidly mounted at a lower end thereof on the support frame and an extendable rod portion 28*b* connected at an upper end thereof to bracket set 30. Cylinder assemblies 27 and 28 are operated in unison by control unit 20 to position upper annular member 25 within opening 23 of the support pan as shown in FIGS. 3 and 4, and at a position about lower annular member 26 as shown in FIG. 5.

In the use of apparatus 11 for unloading the contents of a bag 11, the bag is first transported from a storage or other area, usually by means of a forklift truck, and mounted on the apparatus as shown in FIG. 1 with the discharge spout portion thereof positioned above hopper 16. The discharge spout is then unfolded, passed through upper annular member 25 disposed in its uppermost position within opening 23 of the spillage pan, and fitted over the outer portion of lower annular member 26, as shown in FIGS. 3 and 4. Once the lower end of the spout is fitted over the outer portion of lower annular member 26, controls on the apparatus are operated to cause rod portions 27*b* and 28*b* of assemblies 27 and 28 to retract and correspondingly displace upper annular member 25 from the position shown in FIG. 4 to the position shown in FIG. 5. As upper annular member 25 thus is displaced, it causes the portion of discharge spout 14 fitted about lower annular member 26 to become permanently clamped between annular members 25 and 26. The interior of the discharge spout thus communicates with the inlet of the hopper and is sealed from the exterior of the spout and the hopper to preclude the loss of material or the escape of dust. With the assembly thus positioned, the restraining device at the upper end of the discharge spout may be removed to permit material in the main body portion of the bag to gravity flow through the spout and into the hopper.

To prevent the possible loss of material when connecting or disconnecting the bag spout to or from the hopper, a spillage pan may be provided below the support pan and about the hopper. Such pan may be provided with an annular bottom wall seated on the upper ends of the cylinder portions of clamping assemblies 27 and 28, and an annular side wall for retaining material on the pan. The exposed portions of the rods of the cylinder assemblies also may be provided with protective bellows to keep powered material out of the cylinder rod seals.

To facilitate the flow of material from the discharge spout into and through the hopper, a conically configured baffle 31 is provided in hopper 16. Such baffle further may be formed of a gas permeable material through which a gas, usually air, may permeate to form a boundary layer of gas on the surface of the baffle which functions to enhance the flow of material through the hopper.

When the bag has been fully unloaded, suitable controls may be operated to displace upper annular member 25 upwardly and thus free the bag spout from the hopper. With the spout thus freed, carrier member 17 may be lifted off of the slide member of the mast by a forklift truck and transported to another location. In lifting the carrier member off of the mast of the apparatus, the discharge spout will be caused to be drawn through upper annular member 25, free of the hopper and the clamping assembly. In operations where the bag is not intended to be fully unloaded, the spout may remain clamped to the hopper as described, and the closure device of the spout may be reemployed to preclude further gravity flow of material from the main body portion of the bag, through the discharge spout into the hopper. If and when additional material from the bag is to be unloaded, such closure device again is released to permit the flow of additional material through the discharge spout.

Preferably, the angle of the inner wall surface of upper annular member 25 and the angle of the outer wall surface of lower annular member 26 are the same to permit a snug fit of member 25 about member 26 with a portion of the spout interposed therebetween in clamped relation. In addition to merely clamping a portion of the discharge spout between such members, a compressible seal may be provided on either of members 25 and 26 which is adapted to engage the portion of the discharge spout extending between members 25 and 26 to provide a seal between a member 25 and 26 and the portion of the discharge spout extending therebetween.

With a connection between discharge spout 12*a* and hopper 16 as described, spillage of material and the creation and escape of dust into the ambient atmosphere is completely prevented, conserving material and avoiding hazardous conditions in the escape of such dust.

From the foregoing detailed description, it will be evident that there are a number of changes, adaptations, and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. An assembly for detachably securing the depending discharge spout of a suspended bag to a hopper, permitting material in said bag to flow into said hopper, comprising:

a first member having a frusto-conical configuration defining an opening through which said spout may be extended;

a second member having a frusto-conical configuration defining an opening communicating with an inlet of said hopper, about which a portion of said spout extending through the opening of said first member may be fitted; and means for displacing said first and second members in relation to each other when said spout is extended through the opening of said first member and fitted about said second member to cause a portion of said spout to be interposed between said first and second members in clamped relation.

2. Assembly according to claim 1 wherein said second member is mounted on said hopper.

3. An assembly according to claim 2 wherein said second member is formed integrally with said hopper.

4. An assembly according to claim 1 wherein said displacing means comprises at least one fluid actuated cylinder assembly.

5. An apparatus according to claim 1 including a conically-configured baffle mounted in said hopper.

6. An apparatus according to claim 5 including means for providing a fluidized boundary layer on said baffle for enhancing the flow of material flowing through said spout with said hopper.

7. An assembly according to claim 1 including a seal disposed on one of said first and second members engageable with said portion of said spout interposed therebetween.

8. An apparatus for unloading a suspended bag containing a bulk particulate material, having a depending discharge spout, comprising:

a support means;

means for mounting said bag in said support means;

a hopper mounted on said support means;

a first member having a frusto-conical configuration defining an opening through which said spout may be extended when said bag is mounted on said support means;

a second member having a frusto-conical configuration defining an opening communicating with an inlet of said hopper, about which a portion of said spout extending through the opening of said first member may be fitted, and means mounted on said support means for displacing said first and second members in relation to each other when said spout is extended through the opening of said first member and fitted about said second member to cause a portion of said spout to be interposed between said first and second members in clamped relation.

9. An apparatus according to claim 8 wherein said second member is mounted on said hopper.

10. An apparatus according to claim 9 wherein said second member is formed integrally with said hopper.

11. An apparatus according to claim 8 wherein said displacing means comprises at least one fluid actuated cylinder assembly mounted on said support means and connected to said first means.

12. An apparatus according to claim 8 including a pan mounted on said support means having an opening through which said spout may be inserted.

13. An apparatus according to claim 12 wherein said first member is displaceable between a first position disposed within said opening in said pan and a second position pressing a portion of said spout against said second member when said spout portion is fitted about said second member.

14. An apparatus according to claim 13 wherein said first and second members are annular.

15. An apparatus according to claim 13 wherein said first and second members are provided with cooperating frusto-conically configured surfaces.

16. An apparatus according to claim 15 wherein said displacing means comprises at least one fluid actuated cylinder assembly mounted on said support means and connected to said first member.

17. An apparatus according to claim 13 wherein said first member includes a pair of brackets and said displacing means comprises a pair of fluid actuated cylinder assemblies, each having a cylinder mounted on said support means and a rod connected to a bracket of said first member.

* * * * *

UNITED STATES PATENT AND TRADEMARK OFFICE

CERTIFICATE OF CORRECTION

PATENT NO. : 6,722,402 B2
DATED : April 20, 2004
INVENTOR(S) : Richards A. Ambs et al.

It is certified that error appears in the above-identified patent and that said Letters Patent is hereby corrected as shown below:

Title page,
Item [57], ABSTRACT,
Line 13, please insert -- in -- between "members" and "relation".

Column 6,
Line 24, please delete "15" and insert -- 13 -- in lieu thereof.

Signed and Sealed this

Tenth Day of August, 2004

JON W. DUDAS
*Acting Director of the United States Patent and Trademark Office*